United States Patent [19]

Newberry

[11] 4,336,785

[45] Jun. 29, 1982

[54] MAGNETO IGNITION WITH FIELD-RESPONSIVE BIASING

[75] Inventor: Richard D. Newberry, Springfield, Mass.

[73] Assignee: Eltra Corporation, Toledo, Ohio

[21] Appl. No.: 144,520

[22] Filed: Apr. 28, 1980

[51] Int. Cl.[3] ..... F02P 1/00

[52] U.S. Cl. ..... 123/605; 123/649; 123/149 A; 315/209 SC

[58] Field of Search ..... 123/599, 598, 601, 605, 123/648, 651, 649, 149 A, 149 D; 315/209 SC, 209 CD

[56] References Cited

U.S. PATENT DOCUMENTS

| | | | |
|---|---|---|---|
| 2,898,392 | 8/1959 | Jaeschke | 123/651 |
| 3,484,677 | 12/1969 | Piteo | 123/651 |
| 4,090,488 | 5/1978 | Ohki et al. | 123/651 |
| 4,099,509 | 7/1978 | Hashimoto | 123/149 A |
| 4,120,277 | 10/1978 | Ehlen | 123/599 |
| 4,188,930 | 2/1980 | Santi | 123/651 |
| 4,194,482 | 3/1980 | Jackson | 123/149 D |
| 4,204,490 | 5/1980 | Ohki et al. | 123/149 A |
| 4,270,510 | 6/1981 | Nanjo et al. | 123/149 D |

FOREIGN PATENT DOCUMENTS

| | | | |
|---|---|---|---|
| 52-44343 | 7/1977 | Japan | 123/648 |

OTHER PUBLICATIONS

"Solid State C–D Ignition" by Brice Ward, Radio Electronics, pp. 32–34, Feb. 1967.

*Primary Examiner*—P. S. Lall

*Attorney, Agent, or Firm*—James P. DeClercq

[57] ABSTRACT

A magneto ignition system having inherent means for providing operating biases for components thereof at temperature extremes is disclosed. The disclosed ignition system includes an ignition coil (10) having primary and secondary coil (12, 14) a solid state or semiconductor switch (24) being connected across the primary coil (12) for switching the current therein, and drive and trigger coils (20, 34). The semiconductor switch (24) is driven toward a nonconductive state, to cause an ignition impulse in the secondary coil, by semiconductor latching device (32) which shunts the signal from the drive coil (20) to ground (38). The semiconductor latching device (32) is activated by a trigger coil (34), having a separate magnetic flux path.

In order to provide reliable switching at extremes of ambient temperature, means (22) responsive to the common magnetic field of the primary coil, the secondary coil, and the drive coil are provided to effectively provide operating bias to the latching device (32). In the illustrated embodiment, the means responsive to the magnetic field are paths on a printed circuit board (52, 52*a*) interconnecting the coils and components of the magneto ignition system. When the magnetic field begins to collapse in response to a trigger pulse, this collapsing magnetic field generates a voltage to insure that the latching device (32) reliably changes to a conductive state, and that the switch device (24) reliably changes to a fully nonconductive state, either by decreasing the effective impedance of the electrical path through the latching device (32) or by increasing the effective impedance of the electrical path to the semiconductor switch device (24).

9 Claims, 6 Drawing Figures

MAGNETO IGNITION WITH FIELD-RESPONSIVE BIASING

BACKGROUND OF THE INVENTION

This application is related to the field of magneto ignition systems. In particular, this application relates to a magneto ignition system provided with biasing means responsive to a magnetic field to enhance the operation of switching devices.

Magneto ignition systems are well known. Such systems operate by inducing a current in the primary winding of an ignition coil, allowing flux to build up in the ignition coil, and suddenly interrupting the current in primary winding of the ignition coil, causing the flux to collapse, the collapsing flux inducing a high ignition impulse voltage in the secondary winding of the ignition coil. The current in the primary winding may be interrupted by conventional ignition breaker points. Or, it is also known to interrupt the current in the primary winding in response to voltage induced in a separate trigger coil, also responsive to the rotating magnet, but having a separate magnetic path and physical displacement from the ignition coil.

It has been found desirable to use a solid state switch device which may be a transistor, or any other solid state switch device in parallel with the primary winding. It has also been found desirable to provide shunting means responsive to a trigger coil to actuate the solid state switch device towards a nonconductive state, with the shortest possible switching time, and which latches the switch device in the nonconductive state for the remainder of an ignition cycle, to reduce the inherent oscillatory behavior of such ignition systems. Without such a latching device, current may start to flow again in the ignition coil windings, resulting in oscillations that may cause interrupted energy transfer to the secondary winding, preventing optimal impulse voltage generation is said winding.

The shunting device chosen for such systems is typically a semiconductor controlled rectifier or SCR. Such a SCR may be connected to shunt or bypass the drive signal to the semiconductor switch device from a drive winding, to switch it towards a fully nonconductive state. As is known, the required operating bias and sensitivity of a SCR varies with temperature, and the sensitivity of a solid state switch device varies with temperature. A SCR requires a higher operating bias to function dependably at low temperatures, and a transistor has less resistance between its base and emitter at elevated temperatures. This combination of characteristics in such a system may result in an engine which is difficult to start at low temperature due to marginally insufficient operating bias on the SCR, and an engine which misfires or is hard to start at higher temperatures, the lowered resistance of the transistor operating to shunt the bias voltage for the SCR, and reduce it to an unacceptable level, as well as increasing current flow into the transistor, preventing it from reaching a fully-nonconductive state.

Previously, additional components were provided to insure adequate operating bias for the shunt device. Such efforts have lead to complex and expensive circuits, and have interferred with optimum operating characteristics of such an ignition system at normal intermediate temperatures.

The instant invention provides proper operation for a magneto ignition system, with a minimum of parts or components, and without interferring with the optimum operation of such a system.

SUMMARY OF THE INVENTION

It is a primary object of the invention to provide a means responsive to a magnetic field of a magneto ignition system, principally due to current through a primary winding, and partially responsive to other windings, for driving the solid state switch device more rapidly toward its nonconductive state to collapse the primary winding field and produce an ignition spark when it is being driven toward its nonconductive state in response to the rotating magnet.

It is a further object of the invention to provide a means responsive to the magnetic field of coils having a common path, which provides operating bias for an SCR or similar latching shunting device during the time it is being driven from a nonconductive state to a conductive state. It is an advantage of the invention that no additional components need be used to provide these desirable driving and biasing signals. It is a feature of the invention that these means responsive to the magnetic field of the coils are one or more paths on a printed circuit board used to mount and interconnect the solid state switches and the coils, to form an operative magneto ignition system.

DETAIL DESCRIPTION OF THE INVENTION

Figure 1:
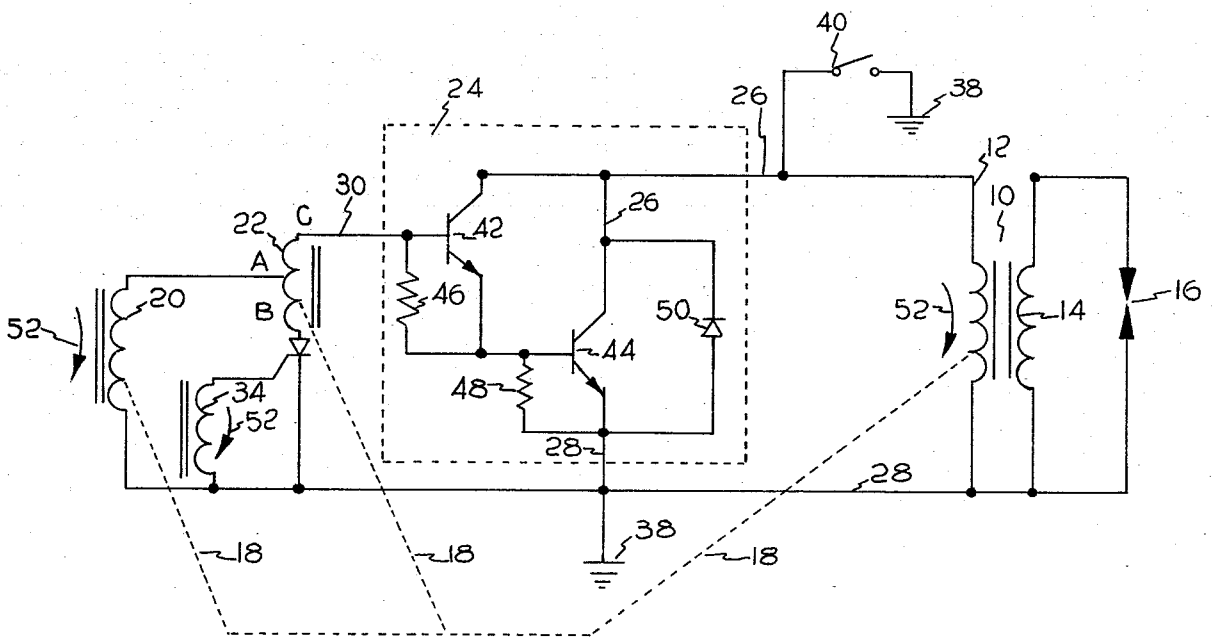
FIG. 1 is schematic diagram of an ignition system according to the invention.

Referring to FIG. 1, showing a schematic illustration of a magneto ignition system according to the invention, includes a magnetic means, shown as an ignition coil 10 having a primary winding or coil 12 and a secondary winding or coil 14. The secondary winding or coil 14 is connected to a spark gap 16. As shown, in the preferred embodiment ignition coil 10 may share a common magnetic path 18 with a drive coil 20 and with a means illustrated as a tapped winding 22, having terminals A, B and C. It should be noted that a common magnetic path is not necessary to practice the principles of the invention. A solid state switch device 24, here shown as Darlington transistor assembly, has a collector lead 26, an emitter lead 28 and a base lead 30. Collector lead 26 and emitter lead 28 are connected across primary winding 12 of ignition coil 10 to form a current path. A control terminal shown as base lead 30 of solid state switch device 24 is connected to an anode of a shunting device which may be a SCR 32, and to drive coil 20, a portion of means 22 lying between terminals A and C of means being interposed between base lead 30 and drive coil 20, and a portion of means 22 lying between terminals A and B being interposed between drive coil 20 and the anode of SCR 32, a portion lying between terminals B and C of means 22 thus being interposed between the anode of SCR 32 and base lead 30. Trigger means shown as trigger coil 34 is connected to a gate lead 36 of shunting device 32. The cathode of shunting device 32, the emitter lead of solid state switch device 24, and common terminals of drive coil 20, trigger coil 34, primary winding 12 and secondary winding 14 are connected to ground 38. A switch 40 is interposed between collector lead 26 and ground 38. As will be apparent, switch 40 is intended for use in stopping an engine provided with such an ignition system by shorting primary winding 12 of ignition coil 10, thus preventing a sudden change in current in primary winding 10, and preventing ignition impulses in secondary winding 14.

Switch device 24 may be any switch device responsive to an actuating or drive signal. It may be a single transistor, or it may be, as illustrated in FIG. 1, a commercially-available Darlington transistor assembly, shown as including transistors 42 and 44, each having a collector connected to collector lead 26. The emitter lead of transistor 42 is connected to the base lead of transistor 44, transistor 44 having an emitter lead connected to emitter lead 28 of solid state switch device 24. Transistor 42 is provided with a biasing resistor 46 connected between its base and emitter, and transistor 44 has a biasing resistor 48 connected between its base and emitter. Solid state switch device 24 is also provided with a protective diode 50, for preventing negative portions of the ringing voltage induced in the ignition coil 10 by the discharge of an ignition pulse through spark gap 16 from damaging solid state switch device 24.

A rotating magnetic field 52 is coupled to ignition coil 10, drive coil 20, and trigger coil 34. At the beginning of an ignition cycle, field 52 attempts to induce a current through primary winding 12 of ignition coil 10. Simultaneously, field 52 induces a drive voltage in drive coil 20, which is applied to base lead 30 of solid state switch device 24, to force solid state switch device 24 to a conductive state, and allow current to flow in primary winding 12. It should be noted that drive coil 20 may be replaced by any other suitable means for forcing solid state switch device 24 to a conductive state, such as placing a resistor between lead 26 and 30.

Subsequently, preferably at a time when the current in primary winding 12 has reached a maximum value, rotating field 52 induces a trigger voltage in trigger coil means 34, which is applied to gate lead 36 of the shunting device shown as SCR 32, causing it to become conductive. It should be noted that mechanical switches, or circuits sensing voltage or current levels within the ignition system may also be used to energize a shunting device, which need not be a latching device. As shunting device 32 starts to become conductive, the drive signal from drive coil 20 is diverted or shunted through SCR 32 to ground 38, removing drive from base lead 30 of solid state switch device 24, causing it to become less conductive. As solid state switch device 24 becomes less conductive, the current in primary 12 decreases, and the flux in ignition coil 10 begins to collapse, to generate an ignition impulse in secondary winding 14. As the flux collapses, the varying flux field in common magnetic path 18 acts upon means 22, inducing voltage in means 22. The induced voltages in means 22 preferably places terminal B at a positive voltage with respect to terminal A, and places terminal A positive with respect to terminal C. When terminal B is positive with respect to terminal A, the impedance of the path for current from drive coil 20 through shunting device 32 is lowered, diverting current from switch device 24 to turn it off, as well as providing reliable biasing to latching device 32. When terminal A is positive with respect to terminal C, the effective impedance of base lead 30 is increased, diverting current from drive coil 20 from switch device 24 to shunting device 32. This too provides reliable biasing to insure that shunting device 32 will reliably complete a transition to a fully conductive latched condition as well as hastening the switching of switch device 24.

In the embodiments of the invention described below, means 22 is arranged so that a relatively small voltage is induced between terminals A and C when terminal B is positive with respect to terminal A, and a relatively small voltage is induced between terminals A and B when terminal A is positive with respect to terminal C, although it will be obvious that means 22 may be arranged so that all portions of means 22 thereof share equally in augmenting the switching of switch device 24. Also, the means 22 may be arranged in any suitable manner relative to the changing flux field to produce the biasing signals.

Figure 2:
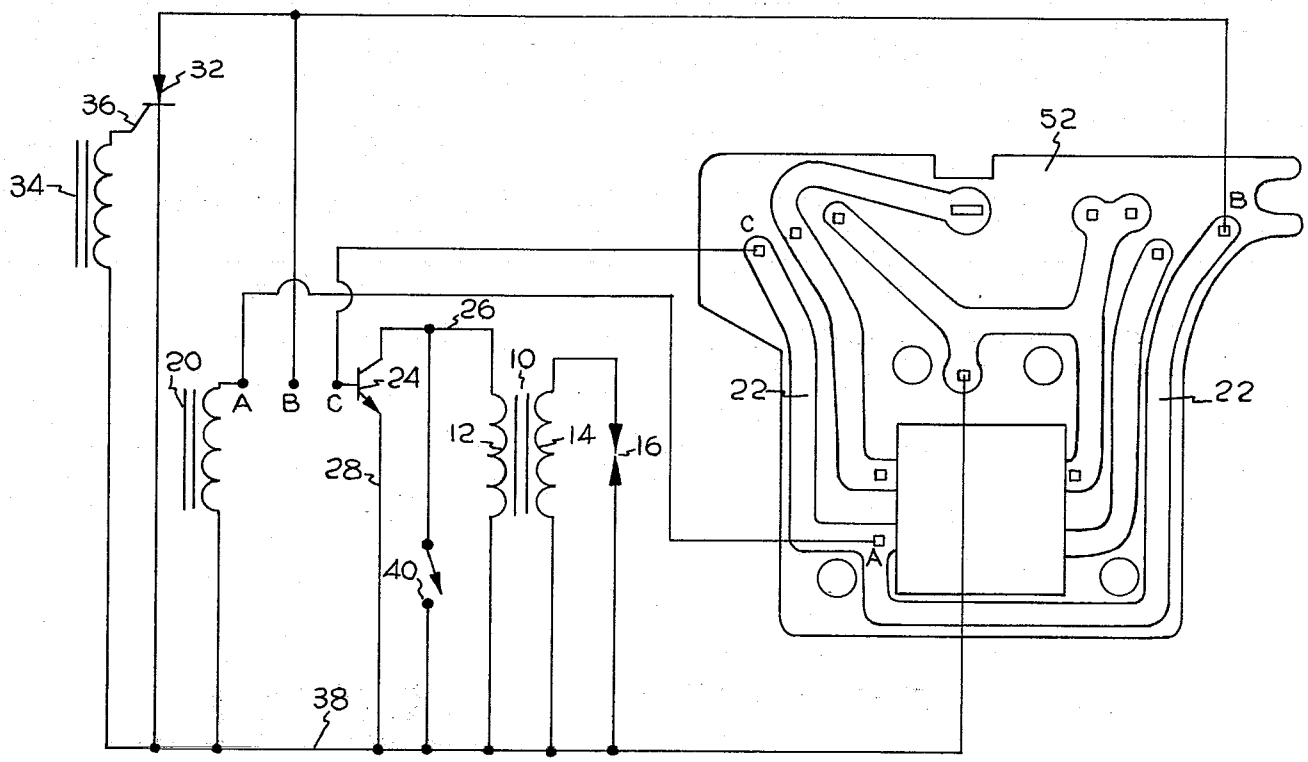
FIG. 2 is a modified schematic diagram of an ignition system according to the invention, showing the connection of paths on a printed circuit board as partial-turn coils to provide drive and bias voltages.

Referring to FIG. 2, identical numbers are used to refer to identical circuit elements, with means 22 being shown as a conductive path on a printed circuit board 52, with terminals A, B and C being connections made along the length of the means shown as path 22.

Figure 3:
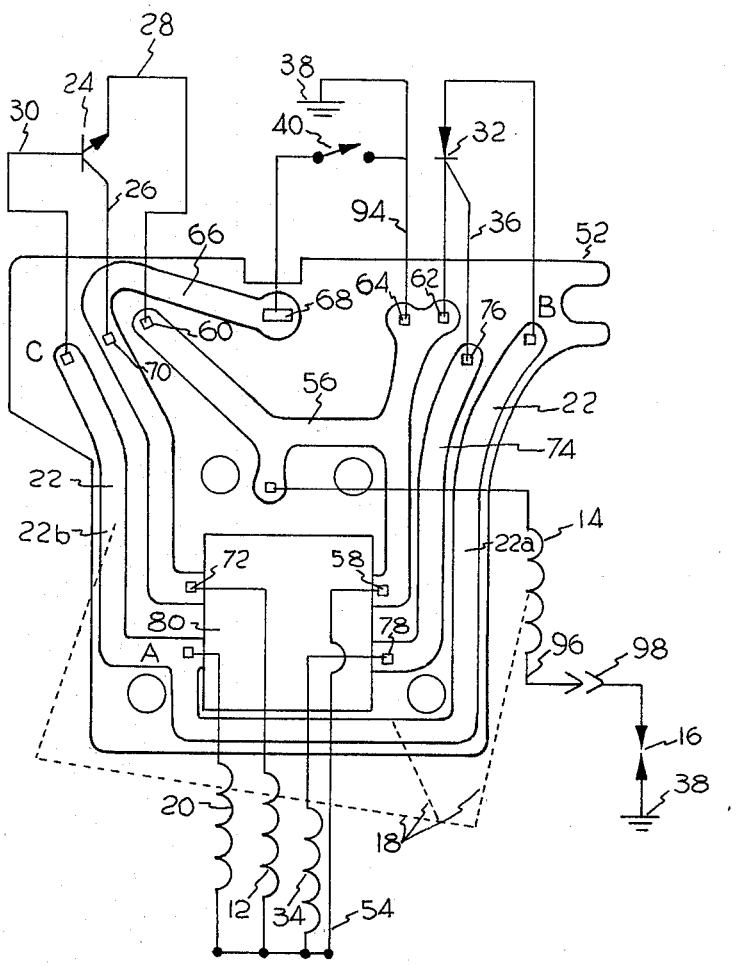
FIG. 3 is an illustration of a printed circuit board showing schematically the placement of the components of an magneto ignition system according to the invention.

FIG. 3 illustrates in schematic form the placement of components upon a printed circuit board 52 in a first preferred embodiment of the invention. Printed circuit board 52 is intended for use in an actual physical embodiment of a magneto ignition system according to the invention, for use with an engine rotating in a counterclockwise direction as viewed with respect to the magneto ignition system. Terminals of primary winding 12, drive coil 20 and trigger coil 34, respectively, are connected to a common point 54. Common point 54 is connected to ground path 56 at a terminal 58. Ground path 56 also includes a terminal 60 for connection of emitter lead 28 of solid state switch device 24, a terminal 62 for connection of the cathode of the shunting device shown as SCR 32, and a terminal 64 for connection of one terminal of switch 40, and external ground 38. A positive path 66 has a terminal 68 for connection to stop switch 40, a terminal 70 for connection to collector lead 26 of solid state switch device 24, and a terminal 72 for connection to primary winding 12. A gate path 74 is provided with a terminal 76 for connection to gate lead 36 of latching device 32, and a terminal 78 for connection to trigger winding 34, thus interconnecting trigger winding 34 and gate 36. Path 22 is provided with terminals A, B and C. Terminal C is connected to base lead 30 of solid state switch device 24. Terminal B is connected to the anode of latching device 32, and terminal A is connected to drive coil 20.

Figure 5:
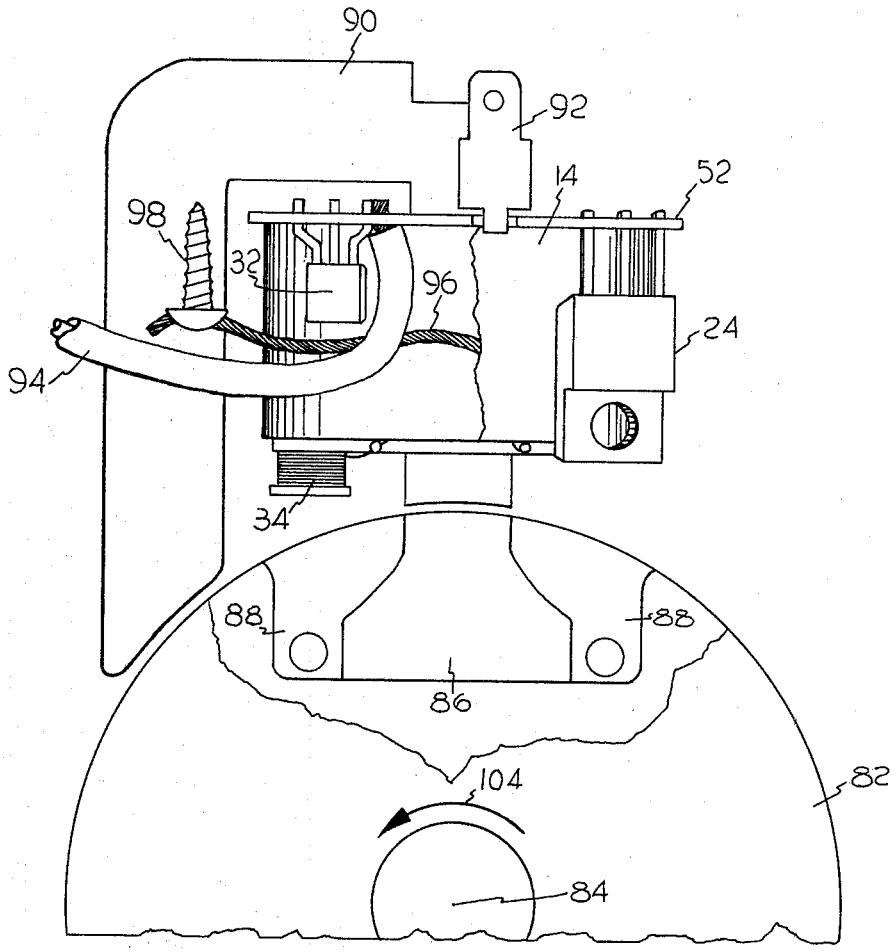
FIG. 5 is a side elevational view of a magneto ignition system according to the invention disposed adjacent a flywheel of an engine.
Figure 6:
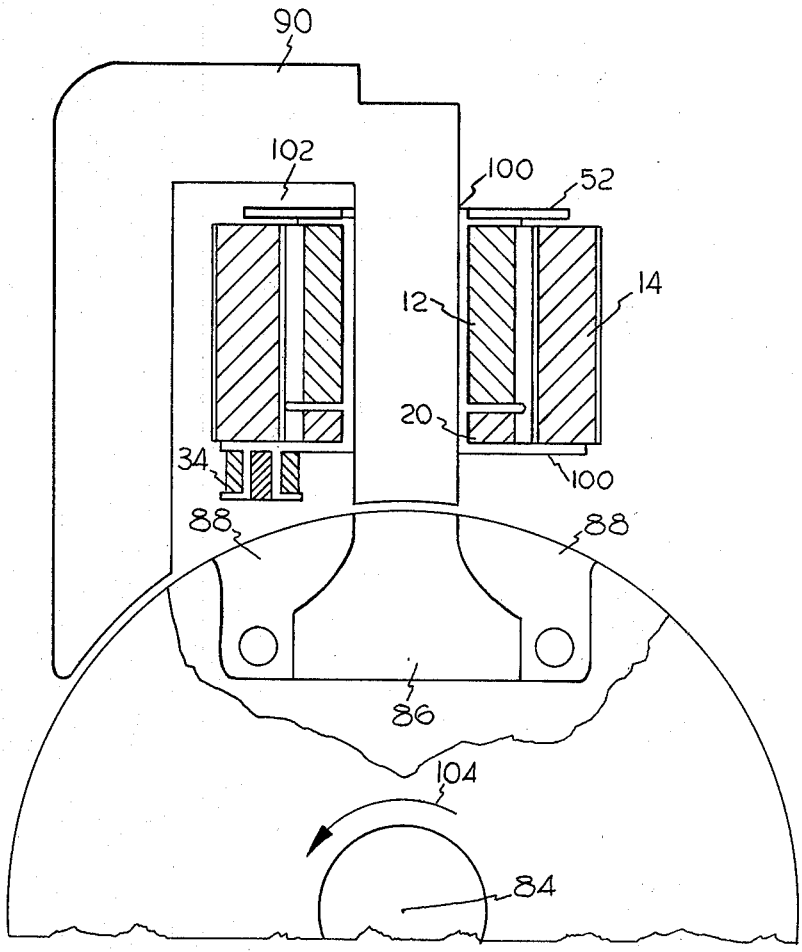
FIG. 6 is side elevational view, partial in section, of an ignition system according to the invention disposed adjacent to flywheel.

When printed circuit board 52 is incorporated in the structure shown in FIGS. 5 and 6, it will be apparent that a leg of a magnetic core passes through aperture 80 in printed circuit board 52, and over printed circuit board 52 in the area provided with terminals 58 and 78. As will be apparent, changes in flux in the leg of the magnetic core passing through aperture 80 and over board 52 will induce voltage primarily in area 22*a* of path 22, although some voltage will be induced in area 22*b* of path 22. As will be apparent, voltages will also be induced in path 74 and in path 56 adjacent portion 22*a*, and in path 66 adjacent area 22*b*. However, these induced voltages are of no significant effect, path 56 being ground, path 74 carrying a signal from trigger coil 34 which is of substantially higher magnitude, and any voltage induced in path 66, connected to the emitter line of a solid state switch device shown as transistor 24 has insignificant effect on its operation. As can be seen, the voltage induced in area 22*a* would be comparably small due to the slow change in flux as current builds up in primary winding 12 at the beginning of an ignition cycle, but would rise to an appreciable magnitude as the current in primary coil 12 begins to decrease in response to a signal from trigger coil 34. In the system illustrated in FIG. 3, means 22 acts to drive the solid state switch 24 further toward its nonconductive state by effectively lowering the impedance between terminal A of means 22 and the cathode of shunting device 32 to the voltage generated by drive coil 20, thus more rapidly diverting the signal from drive coil 20 away from base lead 30 of semiconductor switch device 24, thus hastening its transition to its nonconductive state, as well as providing effective bias to shunting device 32.

Figure 4:
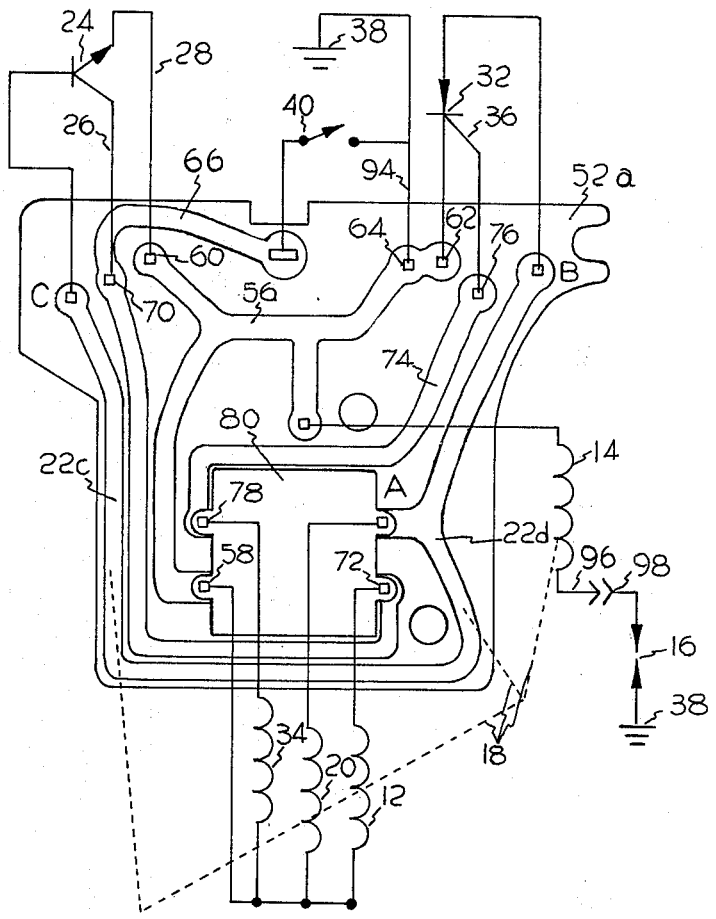
FIG. 4 shows a modification of the printed circuit board shown in FIGS. 2 and 3, to provide a magneto ignition system according to the invention using identical components, for an ignition system for an engine having a flywheel which rotates in the opposite direction from that used with the printed circuit board shown in FIGS. 2 and 3.

In FIG. 4 an alternate embodiment 52*a* of the printed circuit board shown in FIG. 3 is illustrated. This printed circuit board is intended to allow the use of identical coils or windings 12, 14, 20, and 34 in an ignition system according to the invention which has been mechanically reversed for use with a flywheel operating in the opposite direction of rotation from a flywheel usable with the system illustrated schematically in FIG. 3, and illustrated in FIGS. 5 and 6. The same symbols and identifying numbers are used as in FIG. 3, but the paths on the printed circuit board 52*a* have been rearranged. As shown in FIG. 4, the majority of the voltage induced by the rapid change in magnetic flux which occurs in response to a signal from trigger coil 34 is induced in portion 22*c* of path 22, while a smaller voltage is induced in portion 22*d*. In the embodiment shown in FIG. 4, solid state switch device 24 is driven further toward its nonconductive state due to the fact that the voltage appearing between terminals A and C of path 22 acts to oppose the flow of current into base lead 30 of semiconductor switch device 24, hastening the transition of semiconductor switch device 24 to its nonconductive state, and also causing the electrical path through latching device 32 to be of relatively lower impedance, thus diverting current from drive coil 20 through latching device 32 to ground 38. In short, the system shown in FIG. 3 principally operates by dynamically decreasing the impedance in the path to latching device 32, and the system shown in FIG. 4 principally operates by dynamically increasing the impedance of the path to base lead 30.

Referring to FIG. 5, a magneto ignition system including the printed circuit board 52 shown in FIG. 3 is shown disposed adjacent a flywheel 82, rotatable around a axis 84, and having a magnet 86 and pole shoes 88. A U-shaped magnetic core 90 is shown passing through aperture 80 of printed circuit board 52. A tab 92 is provided for connection of stop switch 40, shown in FIGS. 1 to 4. A wire is provided, for connecting to stop switch 40, and for providing the ignition system according to the invention with an external ground 38. Secondary winding 14 is provided with an output lead 96, which is provided with means 98, shown as screw in FIG. 5, for connecting between secondary winding 14 and spark gap 16. In an actual physical embodiment, means 98 is an conventional wood screw, and a section of conventional ignition wire is simply screwed onto means 98, with means 98 making contact with its central conductor. As will be apparent from FIG. 5, as flywheel 82 rotates around axis 84, the field of magnet 86 will first cause a gradually increasing amount of flux to be carried in magnetic core 90. As flywheel 82 continues to rotate, magnet 86 will induce a change in flux in trigger coil 34, inducing an ignition impulse in secondary winding 14.

FIG. 6 shows a sectional view of the embodiment illustrated in FIG. 5. As shown in FIG. 6, primary winding 12, secondary winding 14 and drive coil 20 are wound on a spool 100, printed circuit board 52 being attached to spool 100. It will be apparent that primary coil 12 is the primary source of magnetic flux passing through printed circuit board 52, and it will also be apparent that most of the flux of coil 12 external to coil 12 will flow in core 90, and therefore, that the highest amount of flux, and highest amount of induced voltage in path 22 of printed circuit board 52 will be in area 102, between the bight portion of U-shaped core 90 and printed circuit board 52.

For use with a flywheel which rotates in a direction opposite to direction 104 shown in FIGS. 5 and 6, as will be apparent, core 90 and spool 100 carrying coils 12, 14, 20 and 34, would be reversed from the position shown in FIGS. 5 and 6, and printed circuit board 52*a* substituted for printed circuit board 52.

As will be apparent, numerous variations and modifications of the illustrated embodiments of the invention will be obvious to one skilled in the art, and may be made without departing from the spirit and scope of the invention.

I claim:

1. A magneto ignition system for an internal combustion engine having a rotatable flywheel including a magnet, comprising:

a plurality of first coils having a first common magnetic flux path;

said first coils including an ignition primary coil and an ignition secondary coil;

said ignition secondary coil being magnetically coupled to said ignition primary coil;

a first solid state switch device connected to said ignition primary coil for switching a current therethrough;

said current being induced by a magnetic field of said magnet of said flywheel;

first means responsive to said magnet for driving said first solid state switch device towards a conductive state to allow a flow of current through said ignition primary coil;

second means responsive to said magnet for driving said first solid state switch device towards a nonconductive state for switching said current through said ignition primary coil to cause an ignition impulse in said ignition secondary coil;

third means responsive to a magnetic flux responsive to switching said current through said ignition primary coil in said first common magnetic flux path for driving said first solid state switch device toward said nonconductive state when said first solid state switch device is driven towards said nonconductive state by said second means responsive to said magnet;

said third means including a conductive member adjacent to said first coils;

said conductive member including a conductive path on a printed circuit board adjacent to said first coils;

said printed circuit board having a plurality of conductive paths interconnecting said first coils, said first solid state switch device and said first and second means responsive to said magnet.

2. A magneto ignition system according to claim 1, wherein:

said first means includes a drive coil means operatively connected to said first solid state switch, said first coils including said drive coil means.

3. A magneto ignition system according to claim 2, wherein:

said second means includes trigger coil means and shunting means;

said shunting means being operatively connected to said first solid state switch device to shunt an input signal to said first solid state switch device.

4. A magneto ignition system for an internal combustion engine having a rotatable flywheel including a magnet, comprising:

a first core;

a plurality of first coils mounted on said first core and having a first common magnetic flux path;

said first coils including an ignition primary coil and an ignition secondary coil;

said ignition secondary coil being magnetically coupled to said ignition primary coil;

a first solid state switch means connected to said ignition primary coil for switching a current therethrough;

said current being induced by a magnetic field of said magnet of said flywheel;

first means responsive to said magnet for driving said first solid state switch towards a conductive state to allow a flow of current through said ignition primary coil;

second means responsive to said magnet for driving said first solid state switch towards a nonconductive state to interrupt said flow of current cause an ignition impulse in said ignition secondary coil;

said second means including shunting means operatively connected to said first means and to a control terminal of said first solid state switch;

third means responsive to a change in magnetic flux in said first common magnetic flux path for simultaneously generating a first voltage for opposing a voltage generated by said first means and for generating a second voltage in series with said shunting means and connected electrically between said shunting means and said first means for increasing the rate of interruption of said current.

5. A magneto ignition system according to claim 4, wherein:

said third means includes a conductive path on a printed circuit board disposed adjacent said first coils.

6. A magneto ignition system according to claim 5, wherein:

said conductive path has a first portion and a second portion, said first portion being electrically connected to said first means and to said control terminal and said second portion being electrically connected to said first means and to a controlled terminal of said shunting means.

7. A magneto ignition system according to claim 6, wherein:

said first means includes a drive coil mounted on said first core and operatively connected to said control terminal of said first solid state switch.

8. A magneto ignition system according to claim 6, wherein:

said second means includes a trigger coil responsive to said magnet and mounted on a second core and electrically connected to a control terminal of said shunting means.

9. A magneto ignition system for an internal combustion engine having a rotatable flywheel containing a magnet, comprising:

a first core;

a primary winding mounted on said first core for generating a voltage therein in response to change in flux in said core caused by rotation of said magnet;

a secondary winding mounted on said first core and magnetically coupled to said primary winding for generating an ignition impulse therein in response to stepwise decrease in current in said primary winding;

switch means electrically connected across said primary winding for controlling the flow of current therethrough;

a drive coil for driving said switch means towards a conductive state mounted on said first core and electrically connected to a control terminal of said switch means and responsive to said magnet;

a second core;

a trigger coil responsive to flux in said second core and mounted on said second core;

shunting means operatively connected to said control terminal of said switch means and to said drive coil and responsive to said trigger coil for driving said switch means towards a nonconductive state;

first means electrically interposed between said drive coil and said control terminal of said switch means and second means electrically interposed between said shunting device and said drive coil for simultaneously increasing the effective electrical impedance of said control terminal of said switch means and decreasing the effective electrical impedance of said shunting means, to drive said switch means towards said nonconductive state in response to a change in flux in said first core in response to said switch means controlling the flow of said current through said primary winding, and to provide an effective electrical bias to said shunting means.

* * * * *

UNITED STATES PATENT AND TRADEMARK OFFICE

CERTIFICATE OF CORRECTION

PATENT NO. : 4,336,785

DATED : June 29, 1982

INVENTOR(S) : Richard D. Newberry

It is certified that error appears in the above-identified patent and that said Letters Patent are hereby corrected as shown below:

Column 1, line 15, before "primary" insert --the--;
line 63, change "lead" to --led--.
Column 2, line 29, before "schematic" insert --a--;
line 38, before "magneto" change "an" to --a--;
line 50, after "FIG. 6 is" insert --a--, change "partial" to --partially--;
line 51, before "flywheel" insert --a--;
line 54, change "DETAIL" to --DETAILED--;
line 67, after "as" insert --a--.
Column 6, line 8, after "as" insert --a--;
line 11, change "an" to --a--.
Claim 2, line 4, change the comma to a semicolon.

Signed and Sealed this

*Nineteenth* Day of *October 1982*

[SEAL]

*Attest:*

GERALD J. MOSSINGHOFF

*Attesting Officer*

*Commissioner of Patents and Trademarks*